US005514295A

United States Patent [19]

Flower

[11] Patent Number: 5,514,295

[45] Date of Patent: May 7, 1996

[54] DISPENSABLE POWDER DETERGENT

[75] Inventor: David M. Flower, Grand Rapids, Mich.

[73] Assignee: Amway Corporation, Ada, Mich.

[21] Appl. No.: 438,909

[22] Filed: May 10, 1995

Related U.S. Application Data

[62] Division of Ser. No. 175,695, Dec. 30, 1993, Pat. No. 5,546,854, which is a continuation of Ser. No. 901,516, Jun. 19, 1992, abandoned.

[51] Int. Cl.[6] ..... C11D 17/06; C11D 1/66; C11D 3/20

[52] U.S. Cl. ..... 252/174; 252/174.13; 252/174.21; 252/135; 252/89.1; 252/363.5

[58] Field of Search ..... 252/174, 174.13, 252/174.21, 135, 363.5, 89.1

[56] References Cited

U.S. PATENT DOCUMENTS

| | | | |
|---|---|---|---|
| Re. 33,646 | 7/1991 | Klemm et al. | 252/90 |
| 2,166,315 | 7/1939 | Martin | 87/5 |
| 3,962,149 | 6/1976 | Chirash et al. | 252/540 |
| 3,971,726 | 7/1976 | Smith et al. | 252/132 |
| 3,975,280 | 8/1976 | Hachmann et al. | 252/102 |
| 4,006,110 | 2/1977 | Kenney et al. | 252/540 |
| 4,125,475 | 11/1978 | Kolaian et al. | 252/89.1 |
| 4,136,045 | 1/1979 | Gault et al. | 252/135 |
| 4,140,650 | 2/1979 | Wilde | 252/135 |
| 4,707,290 | 11/1987 | Seiter et al. | 252/140 |
| 4,806,266 | 2/1989 | Burrill | 252/174.15 |
| 4,824,593 | 4/1989 | Appel et al. | 252/127 |
| 4,849,125 | 7/1989 | Seiter et al. | 252/109 |
| 4,966,606 | 10/1990 | Garner-Gray et al. | 252/174.14 |
| 4,970,017 | 11/1990 | Nakamura et al. | 252/174.13 |
| 4,992,193 | 2/1991 | Evans | 252/92 |
| 5,294,361 | 3/1994 | Van den Brom | 252/90 |
| 5,456,854 | 10/1995 | Flower | 252/174 |

FOREIGN PATENT DOCUMENTS

| | | |
|---|---|---|
| 0142910 | 5/1985 | European Pat. Off. . |
| 0360330 | 3/1990 | European Pat. Off. . |
| 2431581 | 1/1976 | Germany . |
| 54-7005 | 4/1979 | Japan . |
| 54-50512 | 4/1979 | Japan . |
| 2082620 | 3/1982 | United Kingdom . |

OTHER PUBLICATIONS

Chemical Abstracts 94: 158711h, May, 1981.

*Primary Examiner*—Paul Lieberman
*Assistant Examiner*—Michael Tierney
*Attorney, Agent, or Firm*—Price, Heneveld, Cooper, DeWitt & Litton

[57] ABSTRACT

The dispensability of granular detergent compositions is enhanced by applying to granular detergent compositions comprising at least one detergent builder a liquified intimate mixture comprising at least one nonionic surfactant, at least one fatty acid and at least one fatty alcohol.

22 Claims, No Drawings

DISPENSABLE POWDER DETERGENT

This is a division of application Ser. No. 08/175,695, filed Dec. 30, 1993, which in turn is a continuation of application Ser. No. 07/901,516, filed on Jun. 19, 1992, now abandoned.

BACKGROUND OF THE INVENTION

This invention relates to granular or powder detergent compositions, and especially to those compositions intended for use in washing machines having a detergent-dispensing feature.

Granular or powder detergent compositions usually contain, in addition to detergent active materials or surfactants, a detergency builder which functions, among other things, to improve the detergency or cleaning level of the compositions, in comparison to unbuilt compositions. In addition to those materials, conventional additives, such as fabric softeners, whiteners, hydrotropes, bleaching agents, bleach activators, enzymes, soil anti-redeposition agents and the like can also be incorporated into granular detergents.

Recently, there has been a trend within the detergent industry toward powders having higher bulk densities than has been customary in the past, for example, 450 grams per liter and above. This trend is market driven, spurred on by ecological considerations, to produce powdered detergents such that a greater weight of powder can be packed in a given volume of a container or box. However, it has been found that the higher density granules often suffer from poor dispensability in automatic washing machines. In these machines, water enters the dispenser which is charged with the granular detergent and flushes the granules into the wash liquor. If the water does not flush out the entire amount of powder, the powder, when it solidifies, can form relatively large clumps which can eventually block the dispenser and/or the feed pipe from the dispenser to the washing compartment of the machine. This results in a wastage of detergent and a lower level of cleaning, or it requires that the user clean out the dispenser and/or feed line, preferably after each wash cycle. The problem is more prevalent with higher density powders, particularly in non-phosphate, zeolite-containing products, at low wash temperatures, including cold-water washes, and at low water pressure and/or water flow rates; and is most extreme in formulas with a high ratio of nonionic, e.g., more than 90% nonionic with respect to ionic surfactant. While the phenomenon is not fully understood, solubilization of at least a portion of the granular detergent to form a pasty- or syrupy-consistency slurry before the granules have been washed out of the dispenser into the wash liquor appears to be a contributing factor.

Several proposals have been offered for improving the dispensability of granular detergent compositions. European Patent Application 360,330 (Unilever PLC) discloses a process for the preparation of a detergent powder, which includes the steps of preparing an intermediate powder, and spraying onto the intermediate powder an intimate mixture of a $C_{8-22}$ fatty acid and a liquid or liquifiable nonionic surfactant. The final detergent powder is said to have a dynamic flow rate of at least 90 ml/s. Garner-Gray et al., U.S. Pat. No. 4,966,606, propose a method for improving dispensability of granular detergent compositions containing sodium carbonate and finely-divided calcite by providing detergent granules or particles which have a mean size of at least 500 microns, with less than two percent by weight of the particles having a size of less than 50 microns. The '606 patent also references other proposals, including those of British Patent Specification No. GB 212093-A (addition of a siliconate to bentonite-containing powders) and European Patent Specification No. EP 49920 (addition of hydrophobic material such as calcium stearate to phosphate/silicate granular dishwashing compositions). Seiter et al., U.S. Pat. No. 4,849,125, propose to employ a powder component which has a certain grain specification and certain additives and quantitative ratios in order to avoid subsequent separation of the granulate and optimize detergent properties. The powders are subsequently impregnated with nonionic surfactant.

SUMMARY OF THE INVENTION

The present invention involves enhancing dispensability of high bulk density powder detergents by applying onto detergent granules an intimate mixture of a nonionic surfactant, a fatty acid and a fatty alcohol. The detergent powders made with this technique contain high levels of surfactant, are almost totally nonionic, and completely dispense an 80–100 gram dosage in a European side-flush dispenser at 0.5 gallons per minute flow rate, in less than two minutes, and more typically in 30–45 seconds.

DETAILED DESCRIPTION OF THE PREFERRED EMBODIMENT

In the preferred embodiment, the dispensing properties of a detergent powder are improved by the application of an intimate mixture of a fatty acid, fatty alcohol and a liquid or liquifiable nonionic surfactant into and onto the detergent base powder, prior to the dry-dosing and/or spraying of other components. In a particularly preferred embodiment of the invention, the detergent base powder is contacted with a portion of the liquid or liquifiable nonionic surfactant followed by the application of the remainder of the nonionic surfactant, the fatty acid and the fatty alcohol. It is believed that this most preferred embodiment tends to leave the fatty acid and fatty alcohol components concentrated to a greater degree at the base particle surface.

The base detergent powders which are suitable for treating in accordance with the present invention can be prepared by substantially any method known in the art. For example, some detergent powders are prepared by spray drying an aqueous slurry of heat-insensitive and mutually compatible ingredients to form a spray-dried granular product, normally referred to as the "base powder." Other desired ingredients that are not to be incorporated via the slurry because of heat sensitivity or incompatibility with other slurry ingredients are then dry-mixed or sprayed onto the base powder. Such base detergent powders can also be prepared by straightforward blending of the ingredients in the presence of less than about 5% water, or by mixing in the substantial absence of water but in the presence of non-aqueous liquid or liquifiable materials, including detergent active materials, such as nonionic surfactants. The base powder which forms from this simplified technique can then be post-dosed with other dry or liquid materials to provide base detergent granules which are then treated with the mixture of fatty acid, fatty alcohol and nonionic surfactant, in accordance with the precepts of the invention.

The principal ingredients of the high density, free-flowing, easily-dispensed granular laundry detergent powder of the invention include at least one nonionic surfactant, at least one builder, at least one fatty alcohol, at least one fatty acid and, optionally, other additives conventionally employed in granular detergent compositions. These principal ingredients are included in the detergent compositions in the following percentage ranges, based on total weight of detergent:

| Ingredient | Range | Preferred Range | Especially Preferred Range |
|---|---|---|---|
| Nonionic surfactant | 12.5–60 | 12.5–40 | 15–25 |
| Builder | 10–85 | 25–80 | 40–75 |
| Fatty alcohol | 0.5–5 | 0.75–2 | 0.75–1.25 |
| Fatty acid | 0.5–5 | 0.75–2 | 0.75–1.25 |
| Optionals | to 100% | to 100% | to 100% |

Substantially any liquid or liquifiable nonionic surfactants which have been habitually used in detergent compositions can be employed in the present invention. A comprehensive listing and discussion of nonionic surfactants or detergents can be found in McCutcheon's Detergents and Emulsifiers, 1973 Annual and in the textbook Surface Active Agents, Vol. II, by Schwartz, Perry and Berch (Inter. Science Publishers, 1958). Particularly preferred nonionic surfactants include: polyethylene oxide condensates of alkyl phenols having from 4 to 25, preferably 4–16, moles of ethylene oxide per mole of alkyl phenol; condensation products of aliphatic alcohols and from 1 to about 25, preferably about 3 to about 16, moles of ethylene oxide per mole of alcohol; condensation products of ethylene oxide with a hydrophobic base formed by the condensation of propylene oxide with propylene glycol; condensation products of ethylene oxide with propylene oxide-ethylene diamine reaction products; water-soluble amine oxides, phosphine oxides and sulfoxides having one alkyl moiety having from about 10 to about 18 carbon atoms and two moieties selected from the group consisting of alkyl groups and hydroxyalkyl groups having from 1 to about 3 carbon atoms; alkyl polysaccharides and fatty acid amines. Currently preferred are ethoxylated alcohols such as Neodol®s 25-3, 23-6.5, 25-7, 45-7 and 45-9 marketed by Shell Chemical Company.

Builders

The granular detergent compositions of the invention also contain at least 10% by weight of at least one water-soluble or water-insoluble inorganic and/or organic detergency builder.

Non-limiting examples of suitable water-soluble inorganic detergent builders include alkali metal carbonates, borates, phosphates, polyphosphates, bicarbonates, silicates, sulphates and chlorides. Specific examples of such salts include sodium and potassium tetraborates, perborates, bicarbonates, carbonates, tripolyphosphates, orthophosphates, pyrophosphates, hexametaphosphates and sulphates.

Examples of suitable organic alkaline detergency builders include water-soluble amino carboxylates and amino polyacetates, such as sodium and potassium glycinates, ethylene diamine tetraacetates, nitrilotriacetates and N-(2-hydroxy ethyl) nitrilodiacetates and diethylenetriamine pentaacetates; water-soluble salts of phytic acid, such as sodium and potassium phytates; water-soluble polyphosphonates including sodium, potassium and lithium salts of ethane-1-hydroxy-1,1-diphosphonic acid, the sodium, potassium and lithium salts of ethylene diphosphonic acid and the like; water-soluble polycarboxylates such as the salts of lactic acid, succinic acid, malonic acid, maleic acid, citric acid, carboxymethyloxysuccinic acid, 2-oxo-xa-1,1,3-propane tricarboxylic acid, 1,1,2,2-ethane tetracarboxylic acid, cyclopentane-cis, cis, cis-tetracarboxylic acid mellitic acid and pyromellitic acid; water-soluble organic amines and amine salts such as monoethanolamine, diethanolamine and triethanolamine and salts thereof.

Another type of detergency builder useful in the present composition comprises a water-soluble material capable of forming a water-insoluble reaction product with water hardness cations preferably in combination with a crystallization seed which is capable of providing growth sites for said reaction product.

The invention is particularly useful when the detergency builder materials comprise insoluble sodium aluminosilicates, especially those having a calcium ionic exchange capacity of at least 200 milligrams equivalent per gram and a calcium ion exchange rate of at least 2 grams per gallon per minute per gram. Particularly preferred builders of this type are the zeolites A and X, preferably containing from about 7 to about 26% water of hydration.

Fatty alcohols which can be employed in the practice of the invention include substantially any of the known fatty alcohols having from about 8 to 22 carbon atoms with fatty alcohols having from 14 to 18 carbon atoms being preferred. Particularly preferred are the $C_{16}$ fatty alcohols, such as cetyl alcohols. Other useful fatty alcohols include capryl alcohol, decanol, lauryl alcohol, myristic alcohol, septa decanoic alcohol, octedecanoic alcohol and behenic alcohol.

Substantially any fatty acids from 8 to 22 carbon atoms can be employed in the practice of the invention, with fatty acids having from 16–22 carbon atoms being preferred. Stearic acid is currently the preferred acid of choice. Other useful fatty acids include caprylic acid, capric acid, lauric acid, myristic acid, palmitic acid, margaric acid and behenic acid.

The fatty acid and the fatty alcohol will normally be combined in an amount in the range from about 3 to about 16%, preferably from about 9 to about 12% by weight, based on the weight of total nonionic surfactant. The amount of fatty acid relative to fatty alcohol will generally be in a ratio of 0.7–1.2 parts by weight fatty acid per part by weight of fatty alcohol. Preferably, the ratio of fatty acid:fatty alcohol will be in the range of 0.9–1.05:1. Currently, a ratio of one part fatty acid to one part fatty alcohol is most preferred.

Additional Ingredients

The granular detergent composition of the present invention can be supplemented by the usual additives conventionally employed in detergent compositions. Optional ingredients include other surfactants, e.g., anionic, cationic, amphoteric and zwitterionic surfactants, soil suspending agents at about 0.1% to 10% by weight, including water-soluble salts of carboxymethylcellulose carboxyhydroxymethylcellulose and polyethylene glycols having a molecular weight of about 400 to 10,000. Dyes, optical brighteners and perfumes, enzymes, anti-caking agents such as sodium sulfosuccinate, preservatives such as sodium benzoate, alkaline metal or alkaline earth metal silicates, suds regulating or suppressing agents, natural and synthetic microcrystalline and oxidized microcrystalline waxes, inorganic and organic peroxy bleaching agents, bleaching agent activators, polyphosphonic acids and acid salts. These materials will be employed in the practice of this invention at conventional levels at which they are typically used in detergent formulations.

Formulation Procedure

The mixtures are formed by liquifying the nonionic surfactant, if the nonionic surfactant is not naturally a liquid, and melting and blending the fatty alcohol and fatty acid into the liquified nonionic surfactant. As indicated, the treating mixture is preferably applied in two portions, with a first portion comprising approximately at least 50% and more preferably about 65% of the nonionic surfactant charge, which is initially sprayed onto or otherwise combined with the detergent granule. The liquified mixture of the remaining nonionic surfactant, the fatty acid and the fatty alcohol is sprayed onto or otherwise combined with the previously nonionic surfactant-impregnated granule. After this, final components including oxygen-containing bleaches such as sodium perborate, sodium silicate, the tetraacetyl ethylenediamine bleach activator and enzymes are post-dosed onto the treated granules.

The granular detergent compositions of this invention are typically employed in an amount to provide aqueous solutions containing from about 100 to about 3,000 parts per million, especially from about 500 to 1,500 parts per million of detergent compositions.

The detergent compositions of the invention are prepared following conventional techniques. For example, the base granular detergent compositions of the present invention can be made by spray drying a crutcher mix containing the builder and optional components to form a granular powder base and subsequently treating the powder base with the nonionic surfactant, fatty acid and fatty alcohol mixture in accordance with this invention.

Currently, the preferred method of preparing the granular laundry detergent is to blend the dry powder ingredients, such as builders, and the like, with about 50% by weight of the total nonionic surfactant (which has been liquified) to obtain a substantially homogeneous mixture. The resulting granules will have the nonionic surfactant sorbed into the granules. This granular base is then treated with the intimate mixture of the remainder of the liquified nonionic surfactant, fatty acid and fatty alcohol as previously described.

Granular detergent compositions produced in accordance with this invention have conventional particle sizes in the range of 8 to 100 mesh with a powder density of at least 400 grams per liter, preferably in the range from about 450 to 900 grams per liter and most preferably in the range of about 550 to 800 grams per liter.

EXAMPLES

The following exemplary data show the surfactant systems and dispensing properties of a series of European non-phosphate detergent formulations. The test samples were prepared using the same granular base (zeolite, carbonate, citrate, CMC, polyacrylate, bicarbonate, phosphonate). The melted/liquid nonionic surfactant(s) were added in two portions, the latter containing the stearic acid and/or fatty alcohol (as well as optional liquid ingredients: fragrance and defoaming agent). After this, final post add components including perborate, silicate, TAED (bleach activator) and enzymes were added and mixed.

Detergent compositions are prepared according to the following formulations:

| | Formulation | | | | | | |
|---|---|---|---|---|---|---|---|
| | 1 | 2 | 3 | 4 | 5 | 6 | 7 |
| Ingredient | | | | | | | |
| Part I: Partially Impregnated Base Granules | | | | | | | |
| Granular Zeolite A | 39.00 | 39.00 | 39.00 | 39.00 | 39.00 | 39.00 | 39.00 |
| Sodium citrate dihydrate | 8.00 | 8.00 | 8.00 | 8.00 | 8.00 | 8.00 | 8.00 |
| Sodium carbonate | 11.25 | 11.25 | 11.25 | 11.25 | 11.25 | 11.25 | 11.25 |
| Sodium bicarbonate | 3.15 | 3.15 | 3.15 | 3.15 | 3.15 | 3.15 | 3.15 |
| Carboxymethylcellulose | 2.00 | 2.00 | 2.00 | 2.00 | 2.00 | 2.00 | 2.00 |
| Sodium polyacrylate | 1.00 | 1.00 | 1.00 | 1.00 | 1.00 | 1.00 | 1.00 |
| Sodium phosphonate (25% active on a clay base) | 2.00 | 2.00 | 2.00 | 2.00 | 2.00 | 2.00 | 2.00 |
| Sodium disilicate | 2.00 | 2.00 | 2.00 | 2.00 | 2.00 | 2.00 | 2.00 |
| Tetraacetylethylene diamine | 3.00 | 3.00 | 3.00 | 3.00 | 3.00 | 3.00 | 3.00 |
| Alcoholethoxylate, 7 moles ethylene oxide | 10.00 | 11.00 | 10.00 | 10.00 | 10.00 | 10.00 | 10.00 |
| Part II: Liquids | | | | | | | |
| Alcoholethoxylate, 7 moles ethylene oxide | 5.8 | 4.8 | 4.8 | 4.8 | 4.8 | 7.8 | 7.8 |
| Alcoholethoxylate, 3 moles ethylene oxide | 3.0 | 3.0 | 3.0 | 3.0 | 3.0 | 0.0 | 0.0 |
| Stearic acid | 1.0 | 1.0 | 2.0 | 1.0 | 0.0 | 1.0 | 2.0 |
| Cetyl alcohol | 0.0 | 0.0 | 0.0 | 1.0 | 2.0 | 1.0 | 0.0 |
| Fragrance | 0.2 | 0.2 | 0.2 | 0.2 | 0.2 | 0.2 | 0.2 |
| Non-silicone defoaming agent | 0.5 | 0.5 | 0.5 | 0.5 | 0.5 | 0.5 | 0.5 |
| Part III: Post Adds | | | | | | | |
| Perborate monohydrate | 7.0 | 7.0 | 7.0 | 7.0 | 7.0 | 7.0 | 7.0 |
| Granulate enzyme | 1.0 | 1.0 | 1.0 | 1.0 | 1.0 | 1.0 | 1.0 |
| Fluorescent whitener | 0.6 | 0.6 | 0.6 | 0.6 | 0.6 | 0.6 | 0.6 |
| Dispensing*: | | | | | | | |
| Complete dispensing | — | — | — | 35 sec | — | 45 sec | — |

-continued

| | Formulation | | | | | | |
|---|---|---|---|---|---|---|---|
| | 1 | 2 | 3 | 4 | 5 | 6 | 7 |
| Ingredient | | | | | | | |
| % dispensed, 1 min. | 65 | 50 | 80 | 100 | 10 | 100 | 75 |
| % dispensed, 2 min.** | 70 | 55 | 85 | — | 15 | — | 80 |

*The figures given for dispensing are visual estimates.
**Essentially no product dispenses after 2 minutes.

The resulting product comprised free-flowing granules having a density of about 650 grams per liter. The granular detergent was dosed (100 grams) to an automatic washing machine equipped with a European-style side flush dispenser. Water at a rate of 0.5 gallons per minute was fed to the dispenser. As the data show, detergent granules prepared in accordance with the invention (Examples 4 and 6) were completely dispensed in 35 to 45 seconds whereas detergent granules coated with nonionic surfactant/fatty acid (Examples 1–3 and 7) or nonionic surfactant/fatty alcohol (Example 5) were incompletely dispensed, leaving substantial quantities of clumped detergent in the dispenser and feed line between the dispenser and the washing tub.

By way of further illustration and clarification of the invention, it is important primarily that the nonionic, fatty alcohol and fatty acid be added to the principle granular builder ingredient. In the above examples, the principle builder ingredient is the granular zeolite A at 39% of the final detergent composition. In other formulations, the principle builder might be sodium carbonate, a phosphate or some other ingredient. Thus, in the formulas of the above examples, one could have added the first portion of nonionic to the granular zeolite A only, then blended in the remaining Part I ingredients and, thereafter, blended in the Part II liquid ingredients.

Alternatively, one might have impregnated only the granular zeolite A component with the first portion of nonionic surfactant, and then have coated only those impregnated builder ingredients with the Part II liquids. All of the remaining Part I ingredients could have then been added as Part III post add ingredients.

In yet another variation, the various Part I granular ingredients might first be agglomerated together. These Part I agglomerated granules would then be impregnated with the first portion of nonionic surfactant, followed by contact with the Part II liquid ingredients.

It should be further noted that the Part II liquid ingredients must contain a portion of the nonionic, the fatty acid and the fatty alcohol. The incorporation of other liquid ingredients into this liquid mixture is optional (e.g., the fragrance and defoaming agents). The optional liquid ingredients could be treated as post adds, or even incorporated into the Part I granule mix or agglomerated granules.

Finally, it should be noted that the Part III post add ingredients, while conveniently added last, could alternatively be incorporated into the Part I base granule mix.

The above description is considered that of the preferred embodiment only. Modifications of the invention will occur to those who make or use the invention. Therefore, it is understood that the embodiment described above is merely for illustrative purposes and is not intended to limit the scope of the invention, which is defined by the following claims as interpreted according to the principles of patent law, including the doctrine of equivalence.

The embodiments of the invention in which an exclusive property or privilege is claimed are defined as follows:

1. A method for enhancing dispensability of granular detergent compositions which comprise at least one nonionic surfactant and at least one detergent builder, said method comprising:

contacting a granular detergent base composition comprising at least one builder with a liquified intimate mixture comprising at least one nonionic surfactant, from about 0.75 to about 1.25 weight percent of at least one fatty acid, and from about 0.75 to about 1.25 weight percent of at least one fatty alcohol.

2. A method in accordance with claim 1 wherein said granular detergent base composition is first contacted with at least a portion of said nonionic surfactant and subsequently contacted with said mixture comprising the remainder of said nonionic surfactant, fatty acid and fatty alcohol.

3. The method of claim 2 in which said granular detergent base composition is first contacted with at least about 50% of said nonionic surfactant.

4. The method of claim 2 in which said granular detergent base composition is first contacted with at least about 65% of said nonionic surfactant.

5. A method in accordance with claim 4 wherein the combined amount of said fatty acid and said fatty alcohol is in the range from about 3 to about 16 weight percent, based on the weight of said nonionic surfactant and wherein the amount of fatty acid relative to fatty alcohol is in the range of about 0.7–1.2 parts by weight fatty acid per part by weight fatty alcohol.

6. A method in accordance with claim 5 wherein the fatty acid: fatty alcohol ratio is about 0.9–1.05:1.

7. A method in accordance with claim 4 wherein the combined amount of fatty acid and fatty alcohol is about 9–12 weight percent, based on weight of nonionic surfactant.

8. A method in accordance with claim 7 wherein the fatty acid: fatty alcohol ratio is about 0.9–1.05:1.

9. A method in accordance with claim 1 wherein said fatty acid is stearic acid and said fatty alcohol comprises cetyl alcohol.

10. A method in accordance with claim 9 wherein the combined amount of fatty acid and fatty alcohol is about 9–12 weight percent, based on weight of nonionic surfactant.

11. A method in accordance with claim 10 wherein the fatty acid:fatty alcohol ratio is about 0.9–1.05:1.

12. A method according to claim 1 wherein said granular detergent composition comprises about 12.5 to about percent by weight of at least one nonionic surfactant; from about 10 to about 85 weight percent of at least one builder; from about 0.75 to about 1.25 weight percent of at least one fatty acid; and about 0.75 to about 1.25 weight percent of at least one fatty alcohol, and the balance to 100 weight percent comprising at least one conventional detergent composition additive.

13. A method in accordance with claim 12 wherein said granular detergent base composition is first contacted with at least a portion of said nonionic surfactant and subsequently contacted with said mixture comprising the remainder of said nonionic surfactant, fatty acid and fatty alcohol.

14. The method of claim 13 in which said granular detergent base composition is first contacted with at least about 50% of said nonionic surfactant.

15. The method of claim 14 in which said granular detergent base composition is first contacted with at least about 65% of said nonionic surfactant.

16. A method in accordance with claim 15 wherein the weight ratio of fatty acid:fatty alcohol is about 0.7–1.2:1.

17. A method in accordance with claim 16 wherein said fatty acid:fatty alcohol weight ratio is about 0.9–1.05:1.

18. A method in accordance with claim 14 wherein the weight ratio of fatty acid:fatty alcohol is about 0.7–1.2:1.

19. A method in accordance with claim 18 wherein said fatty acid:fatty alcohol weight ratio is about 0.9–1.05:1.

20. A method in accordance with claim 1 wherein said builder comprises a water-insoluble zeolite.

21. A method in accordance with claim 20 wherein said fatty acid:fatty alcohol weight ratio is about 0.9–1.05:1.

22. A method in accordance with claim 1 wherein said fatty acid is stearic acid and said fatty alcohol comprises cetyl alcohol.

* * * * *

UNITED STATES PATENT AND TRADEMARK OFFICE

CERTIFICATE OF CORRECTION

PATENT NO. : 5,514,295
DATED : May 7, 1996
INVENTOR : David M. Flower

It is certified that error appears in the above-identified patent and that said Letters Patent is hereby corrected as shown below:

Column 3, line 14;

Please insert the heading –Nonionic Surfactants–.

Column 3, line 33;

"moleties" should be –moieties–.

Column 8, Claim 12, Line 60;

Before "percent" insert –60–.

Signed and Sealed this

Tenth Day of December, 1996

Bruce Lehman

*Attest:*

BRUCE LEHMAN

*Commissioner of Patents and Trademarks*

*Attesting Officer*